United States Patent [19]

Napier et al.

[11] 4,332,231

[45] Jun. 1, 1982

[54] COMBINED BOW WITH A UNITARY SIGHT AND CABLE GUARD

[75] Inventors: Loyd S. Napier, 515 E. Dewey, Sapulpa, Okla. 74066; Jim L. Pollard, Sapulpa, Okla.

[73] Assignee: Loyd S. Napier, Sapulpa, Okla.

[21] Appl. No.: 148,985

[22] Filed: May 12, 1980

[51] Int. Cl.[3] ..... F41B 5/00

[52] U.S. Cl. ..... 124/24 R; 124/88; 124/87

[58] Field of Search ..... 124/87, 86, 88, 1, 80, 124/23 R, 24 R; 33/265

[56] References Cited

U.S. PATENT DOCUMENTS

| | | | |
|---|---|---|---|
| 4,054,118 | 10/1977 | McKee et al. | 124/88 X |
| 4,162,579 | 7/1979 | James | 124/87 X |
| 4,170,071 | 10/1979 | Mann et al. | 124/87 X |

OTHER PUBLICATIONS

"Pylon Cable Guard", Archery Magazine, Aug. 1978, p. 24.

"Trim-Line Cable Saver", Archery Magazine, Jun. 1979, p. 4.

*Primary Examiner*—Richard J. Apley
*Assistant Examiner*—William R. Browne
*Attorney, Agent, or Firm*—Head & Johnson

[57] ABSTRACT

A combination cable guard and bow sight apparatus for a bow having both a bow string and cable provided thereon and comprising a substantially flat body adapted to be secured to the central portion of the bow and having a recess therein for receiving an elongated rod member. The rod member being arranged for extending from the bow in a direction toward the bow string and through a sufficiently great distance for engaging the cable and retaining the cable away from the plane of the bow string to preclude interference therebetween during use of the bow, the flat body being further provided with a plurality of elongated apertures, each aperture receiving a sight element therein for improving the aim of the archer using the bow thus providing a single implement which functions as both a cable guard and a bow sighting mechanism.

7 Claims, 8 Drawing Figures

COMBINED BOW WITH A UNITARY SIGHT AND CABLE GUARD

BACKGROUND OF THE INVENTION

1. Field of the Invention

This invention relates to improvements in bows and more particularly, but not by way of limitation, to a combination cable guard and bow sight apparatus.

2. Description of the Prior Art

Many bows in use today include a pair of pulleys journalled in the proximity of the opposite ends of the bow and an endless cable extending around and between the pulleys. The bow string is usually secured to the bow in such a manner that the bow string is disposed outboard of the cable and of course the cable frequently interferes with the positioning and firing of the arrow during use of the bow. Many cable guards are now in use which are secured to the bow and extend outwardly therefrom in a direction toward the cable for holding the cable away from the plane of the bow string. In addition, most bows of this type in use today are provided with an independent bow sighting mechanism which is also secured to the bow, thus requiring the "mutilization" of the bow structure by providing a plurality of bores therein for the installation of the cable guard and bow sighting apparatus.

SUMMARY OF THE INVENTION

The present invention contemplates a combination cable guard and bow sight mechanism incorporated in a single unit which is secured to the bow. The device comprises a relatively flat plate having one end thereof adapted to be secured to the central portion of the bow. The opposite end of the plate extends from the bow in a direction toward the bow string and is provided with a longitudinally extending recess for receiving an elongated rod member therein. The rod extends outwardly from the plate toward the bow string for engagement with the cable in order to hold the cable away from the plane of the bow string. In this manner the cable does not interfere with the positioning and firing of the arrow. In addition, the plate is provided with a plurality of elongated slots, each having a sighting mechanism adjustably mounted therein for use in the usual or well known manner to improve the accuracy of the archer. Use of the novel combination cable guard and sighting mechanism facilitates reduces the number of bores which must be provided in the bow for outfitting thereof, thus reducing detrimental effects on the bow itself and facilitating the installation required for the outfitting operation. The novel combination cable guard and sighting mechanism is simple and efficient in operation and economical and durable in construction.

DETAILED DESCRIPTION OF THE PREFERRED EMBODIMENT

Figure 1:
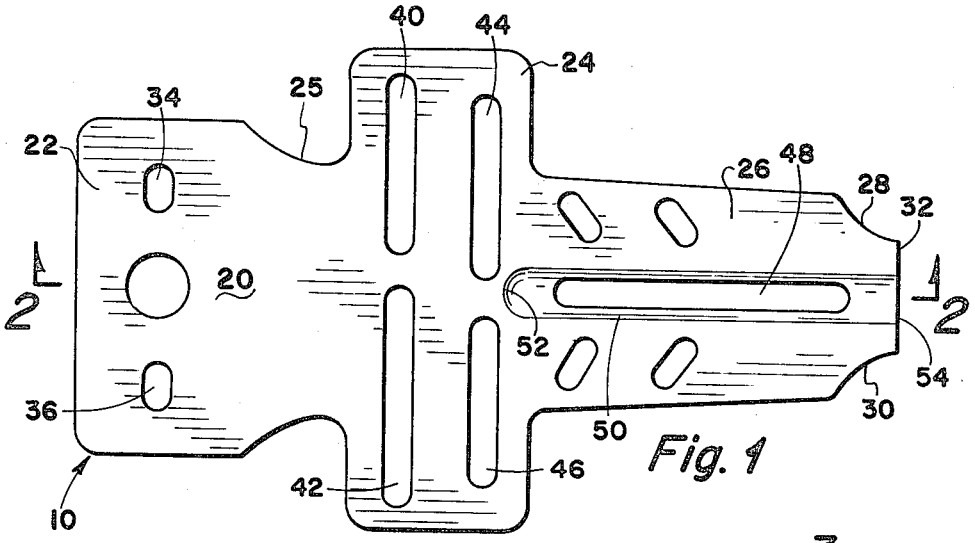
FIG. 1 is a plan view of one side of a combination cable guard and sighting mechanism holder embodying the invention.
Figure 2:
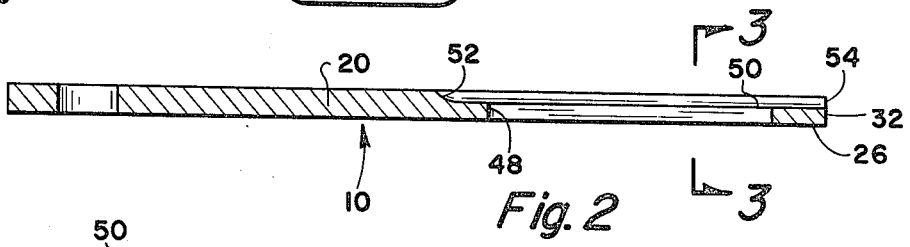
FIG. 2 is a view taken on line 2—2 of FIG. 1.
Figure 8:
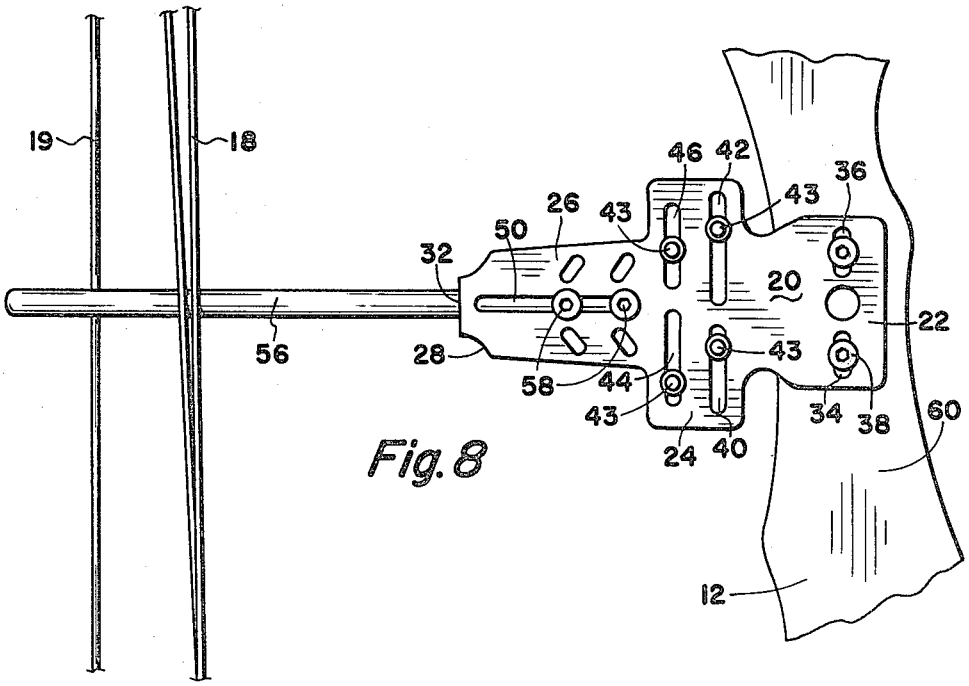
FIG. 8 is a view similar to FIG. 7 illustrating the opposite side of the bow portion and combination cable guard and sighting mechanism of the invention.

Referring to the drawings in detail, reference character 10 generally indicates a cable guard particularly designed for a bow assembly 12 having a pair of pulley members 14 and 16 suitably journalled at the opposite ends thereof and having the usual cable 18 extending therebetween and therearound, as is well known. A bow string 19, which is normally a portion of the cable 18, spans the distance between the pulleys 14 and 16 in the usual manner and is disposed outboard of the cable portion 18, as particularly shown in FIGS. 1 and 8.

The guard 10 comprises a substantially flat plate or body 20 having a first portion 22 of substantially rectangular overall configuration and connected to a second portion 24 by a reduced neck member 25. The second portion 24 is also preferably of a substantially rectangular overall configuration, and is of a greater width than the portion 22 as particularly shown in the drawings. The portion 24 terminates in an elongated portion 26 of a reduced width, and preferably provided with inwardly directed arcuate shoulders 28 and 30 at the outer end thereof which provided a tip end or outer edge 32 of a smaller dimension that the overall width of the plate 20.

The first portion 22 is provided with a pair of spaced, elongated, longitudinally aligned apertures 34 and 36 for receiving suitable screws 38 (FIG. 8) therethrough which are utilized for installing the plate or body 20 on the bow 12 as will be hereinafter set forth. The second portion 24 is provided with a first pair of spaced, elongated, longitudinally aligned slots 40 and 42 for adjustably receiving individual sighting members 43 therein. A second pair of spaced, elongated, longitudinally aligned slots 44 and 46 are provided in the second portion 24 and are spaced from and preferably mutually parallel with the first pair of slots 40 and 42. The slots 44 and 46 are also provided for receiving individual sighting members 44 therein for a purpose and in a manner as will be hereinafter set forth.

Figure 3:
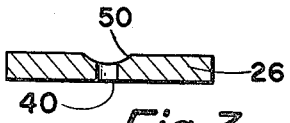
FIG. 3 is a view taken on line 3—3 of FIG. 2.
Figure 4:
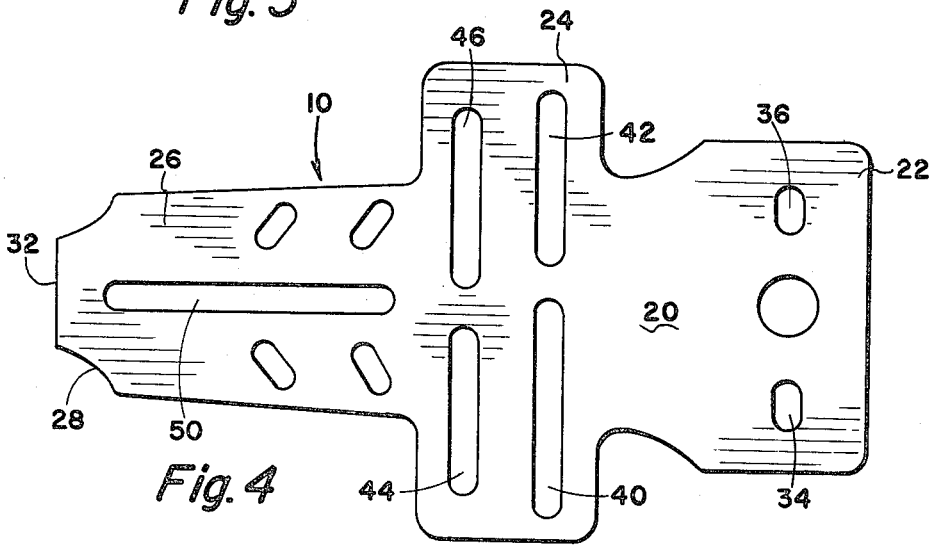
FIG. 4 is a plan view of the opposite side of the combination cable guard and sighting mechanism shown in FIG. 1.
Figure 5:
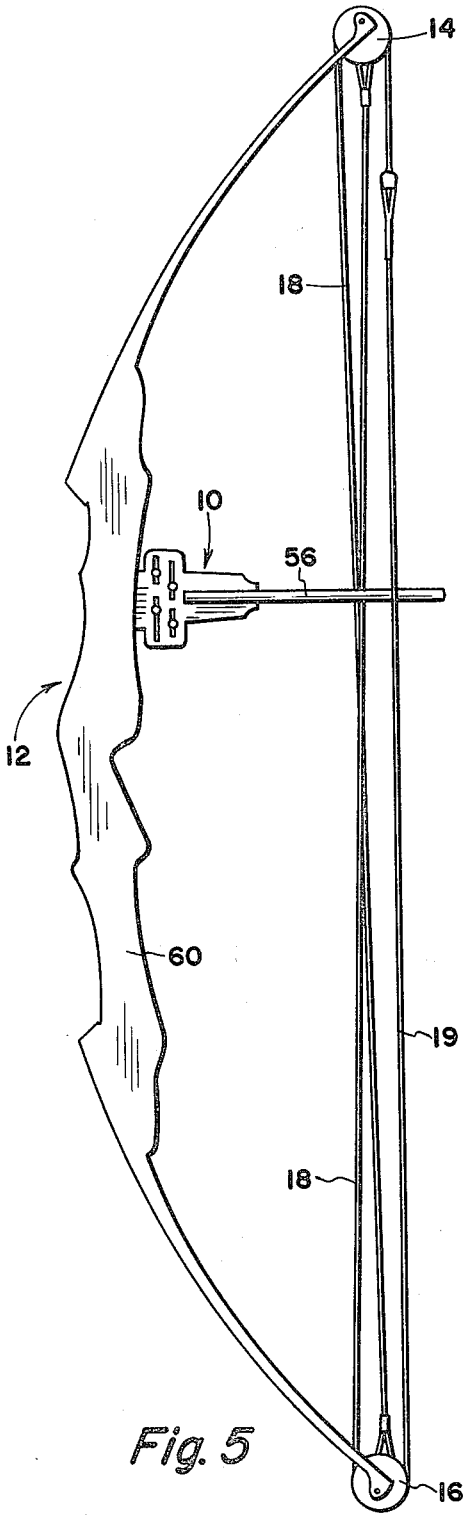
FIG. 5 is a side elevational view of a bow having a combination cable guard and sighting mechanism embodying the invention installed thereon.
Figure 6:
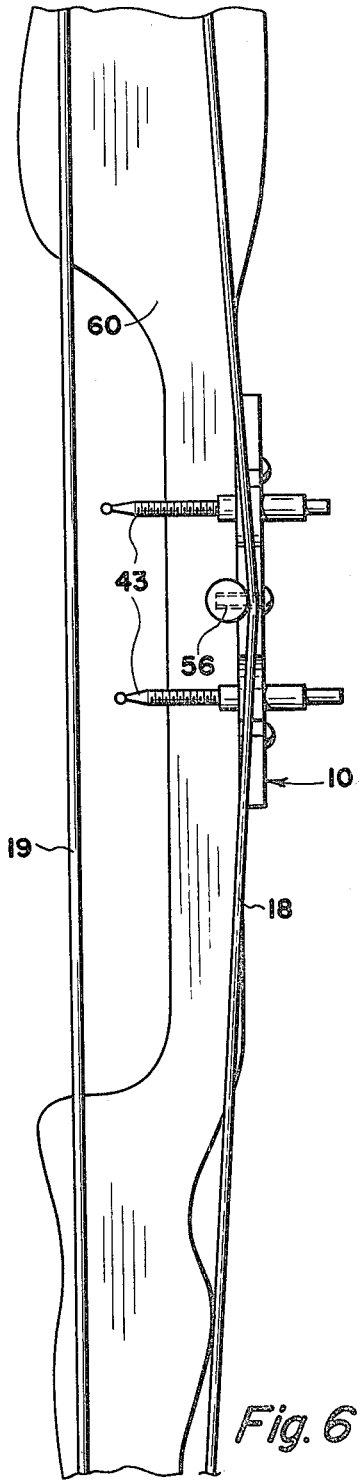
FIG. 6 is an enlarged side elevational view of the central portion of a bow having a combination cable guard and sighting mechanism embodying the invention installed thereon.
Figure 7:
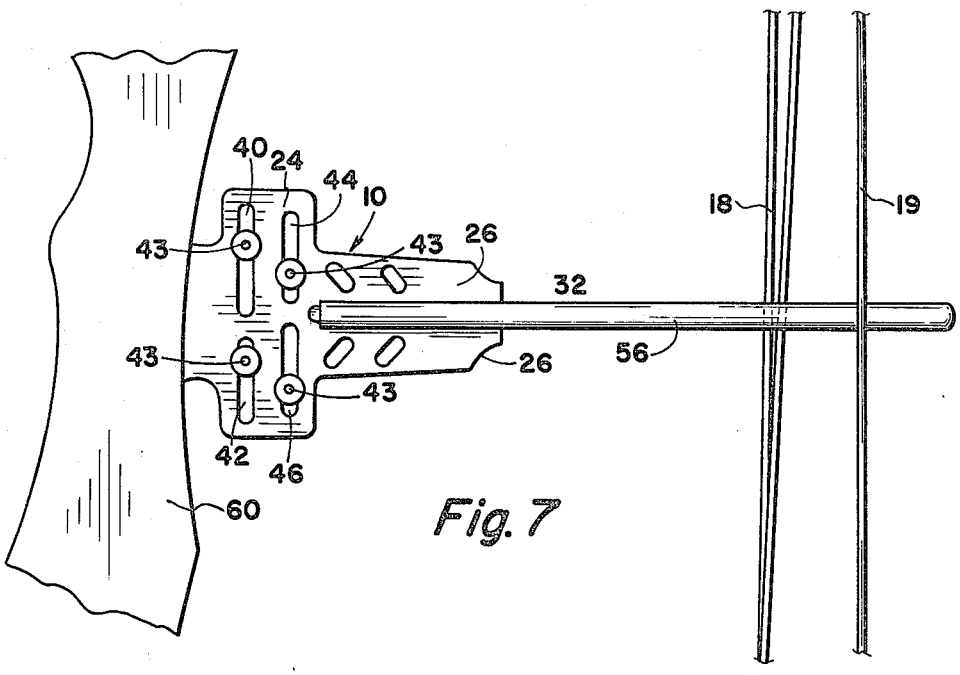
FIG. 7 is an enlarged plan view of one side of the central portion of a bow having a combination cable guard and sighting mechanism embodying the invention installed thereon.

The elongated portion 26 is provided with a centrally disposed elongated slot 48 extending longitudinally therein and disposed within or surrounded by a longitudinally extending a recess 50. The recess 50 is preferably or an arcuate cross-sectional configuration as particularly shown in FIG. 3, and is closed at the inner end 52 thereof and open at the outer end 54.

A rod member 56 of a diametric size substantially corresponding to the arcuate size of the recess 50 is disposed in the recess 50 in such a manner that one end of the rod 56 is in the proximity of the closed end 52 and the outer end of the rod extends through the open end 54 and a considerable distance beyond the end 32 of the body 20. The rod 56 is adjustably secured in the recess 50 in any suitably manner, such as by a plurality of spaced bolts or screws 58 (FIG. 8) which extend through the slot 48 and into the rod 56. The elongated configuration of the slot 48 permits the screws 58 to be positioned at substantially any desired longitudinal position in the slot, thus providing for adjustability of the longitudinal orientation of the rod 56 for a purpose as will be hereinafter set forth.

The sights 43 may be of any suitable adjustable type, such as those shown in the Jimmie Thomas Smith U.S. Pat. No. 4,026,032, issued May 31, 1977, and entitled "Bow Sight Mechanism", and it is preferable that each of the slots or apertures 40, 42, 44 and 46 be provided with an individual sighting mechanism therein. It is also preferable that each of the sighting devices 43 be adjusted for sighting at different distances from the bow 12, thus enabling the archer to utilize the bow for shooting arrows (not shown) at variably spaced targets without alteration of the sighting devices. Additionally, it is preferable that each of the sighting devices 43 be individually identifiable in accordance with the distance adjustment therefor, as for example, the devices 43 may be color-coded for ready recognition by the archer during use of the bow 12.

In order to install the device 10 on the bow 12, it is merely necessary to drill or otherwise provide two holes in the central portion or the bow 12 for receiving the screws or bolts 38 therein. The portion 22 of the body 20 may be placed "flat" against the substantially flat surface of the bow portion 60, with the enlarged portion 24 being disposed away from the portion 60 and extending in a direction toward the bow string 19. The portion 22 may be securely fastened to the bow portion 60 by the screws 38, and the slightly elongated configuration of the apertures 34 permits limited adjustment of the body 20 with respect to the bow 12 in order to assure a proper positioning of the device 10 thereon. The sighting elements 43 may be installed in the respective slots 40, 42, 44 and 46 in the usual manner and properly adjusted as desired, and as well known. Of course, the sighting elements 43 may be secured within the respective slots prior to securing of the device 10 on the bow 12, if desired. The position of the rod 56 within the recess 50 may be adjusted as required in order to assure that the outer end of the rod extends beyond the bow string 19 as particularly shown in FIGS. 5 through 8. The rod 56 is inserted between the bow string 19 and the cable 18 in order to securely retain the cable 18 away from the plane of the bow string, thus precluding interference of the cable 18 with the positioning and release of the arrow (not shown).

From the foregoing it will be apparent that the present invention provides a novel combination cable guard and bow sighting mechanism for use with a bow having pulleys and cables in association therewith. The novel device may be easily installed on the bow with a minimum of alteration of the structure of the bow, thus reducing damage to the bow itself, and providing an efficient means of holding the cable away from the plane of the bow string for increasing the efficiency of use of the bow. In addition, it is not necessary to install a separate apparatus for improving the accuracy of the use of the bow since sighting devices are mounted directly on the cable guard device.

Whereas the present invention has been described in particular relation to the drawings attached hereto, it should be understood that other and further modifications, apart from those shown or suggested herein may be made within the spirit and scope of this invention.

What is claimed is:

1. In combination an archery bow having a bow string and cable, cable guard, sighting means for sighting on a target, said combination further including a substantially flat body member having a first portion for being secured to the bow, a second portion conterminous with the first portion and having a plurality of apertures therein for receiving said sighting means, a third portion conterminous with the second portion and extending outwardly therefrom in a direction toward the bow string when the first portion is secured to the bow, recess means provided on the third portion, elongated rod means adjustably secured in said recess means and having the outer end thereof extending beyond the bow string, said rod means engagable with the cable for holding the cable away from the plane of the bow string during use of the bow.

2. The combination in claim 1 wherein the first portion is of substantially rectangular configuration and provided with a plurality of spaced apertures for receiving screws therethrough whereby the body member may be secured to the bow.

3. The combination in claim 2 wherein the apertures are elongated for adjustability for the positioning of the body member on the bow.

4. The combination in claim 1 wherein the apertures of the second portion comprises a first pair of elongated slots disposed in spaced longitudinal alignment, and a second pair of elongated apertures.

5. The combination in claim 4 wherein said sight means including one independent sighting mechanism, each of said elongated slots receives said at least one independent sighting mechanism therein for facilitating the accuracy of the bow during use thereof.

6. The combination in claim 1 wherein the recess means of the third portion comprises an elongated slot extending longitudinally in said third portion and surrounded by a recess provided in one fact of said third portion, said recess having one closed end and one open end, said rod means extending outwardly from said open end a sufficient distance for engaging the cable when the apparatus is installed on the bow.

7. The combination in claim 6 wherein the recess is of a arcuate cross-sectional configuration corresponding substantially to the diameter of the rod means.

* * * * *